US008559863B2

(12) United States Patent
Gonda et al.

(10) Patent No.: US 8,559,863 B2
(45) Date of Patent: Oct. 15, 2013

(54) IMAGE FORMING UNIT AND IMAGE FORMING APPARATUS

(75) Inventors: Takashi Gonda, Toyokawa (JP); Takuya Wada, Shinshiro (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 266 days.

(21) Appl. No.: 12/981,961

(22) Filed: Dec. 30, 2010

(65) Prior Publication Data

US 2011/0176839 A1 Jul. 21, 2011

(30) Foreign Application Priority Data

Jan. 18, 2010 (JP) ..... 2010-007915

(51) Int. Cl.
*G03G 21/00* (2006.01)
*G03G 15/08* (2006.01)

(52) U.S. Cl.
USPC ..... 399/359; 399/258

(58) Field of Classification Search
USPC ..... 399/263, 359, 358, 258
See application file for complete search history.

(56) References Cited

U.S. PATENT DOCUMENTS

| | | | | |
|---|---|---|---|---|
| 5,499,090 | A * | 3/1996 | Ito et al. | 399/359 |
| 5,881,345 | A * | 3/1999 | Yamane et al. | 399/255 |
| 2006/0216086 | A1 * | 9/2006 | Yuasa et al. | 399/358 |
| 2007/0147898 | A1 * | 6/2007 | Miyata | 399/253 |

FOREIGN PATENT DOCUMENTS

| | | | |
|---|---|---|---|
| JP | 8-286493 | A | 11/1996 |
| JP | 8-286513 | A | 11/1996 |
| JP | 2000-035714 | | 2/2000 |
| JP | 2000-162858 | | 6/2000 |
| JP | 2007-057790 | | 3/2007 |

OTHER PUBLICATIONS

Machine translation of Tsuyama, JP H08-286513.*
English-language translation of Japanese Office Action issued on Aug. 20, 2013 by the Japanese Patent Office in corresponding Japanese Patent Application No. 2010-007915.

* cited by examiner

*Primary Examiner* — David Gray
*Assistant Examiner* — Sevan A Aydin
(74) *Attorney, Agent, or Firm* — Buchanan Ingersoll & Rooney PC

(57) ABSTRACT

An image forming unit including a toner supplier that comprises a cylindrical conveying passage member and a toner conveying rotational body that is inserted into the cylindrical conveying passage member, includes first/second spiral blades formed on different areas of a rotational axis in an axis direction, wound in directions opposite to each other and is rotated so that the first/second spiral blades convey toner in convergent directions. The rotational axis is inclined such that the second spiral blade is higher than the first spiral blade, and the cylindrical conveying passage member comprises a fresh toner receiving opening that receives fresh toner, a collected toner receiving opening that receives collected toner, and a toner supplier opening disposed at a position where the fresh toner conveyed by the first spiral blade and the collected toner conveyed by the second spiral blade meet, so as to supply the toner to the developer.

8 Claims, 5 Drawing Sheets

IMAGE FORMING UNIT AND IMAGE FORMING APPARATUS

This application is based on an application No. 2010-7915 filed in Japan, the contents of which are hereby incorporated by reference.

BACKGROUND OF THE INVENTION (1) Field of the Invention

The present invention relates to an image forming unit that is demountably mounted to an electrophotographic image forming apparatus, and in particular to an image forming unit including a mechanism for collecting and reusing residual toner after transfer, and an image forming apparatus including the image forming unit.

(2) Description of the Related Art

In general, in an electrophotographic image forming apparatus such as a copying machine and a printer, image formation is performed in the following manner. A developer supplies toner to an electrostatic latent image formed on an image carrier such as a photoreceptor drum to develop the electrostatic latent image. The developed toner image is transferred onto a recording sheet and thermally fixed to the recording sheet.

In the transfer, not all of the toner on the image carrier is transferred onto the recording sheet, and a part of the toner remains on a surface of the image carrier. Therefore, prior to a next image forming process, it is necessary to remove residual toner that remains on the surface of the image carrier after transfer. There have been known various methods to remove the residual toner. A method widely used is to scrape the image carrier, and collect the residual toner by having a plate-shaped elastic blade in sliding contact with the surface of the image carrier, because this method is easy and inexpensive.

Conventionally, the collected residual toner has been discarded as waste toner. However, in recent years, in order to effectively utilize resources out of concern for environmental problems, the collected residual toner is conveyed to a developer apparatus or a toner supply apparatus for reuse (recycle) in some image forming apparatuses. The conveyed residual toner is mixed with fresh toner that is discharged from a toner container such as a toner bottle, and used for developing an electrostatic latent image.

Japanese Patent Application Publication No. H8-286513 (hereinafter, Patent Document 1) discloses a toner recycling apparatus that is composed of a fresh toner conveyer and a recycled toner conveyer, and has a mechanism for mixing fresh toner and recycled toner that are each conveyed by the above conveyers and supplying the mixed toner to a developing apparatus.

The recycled toner has been damaged in an image forming process, as surface preparation agents has been buried or detached. Therefore, unfortunately, flowability of the recycled toner is greatly decreased compared to flowability of the fresh toner.

However, with a structure of Patent Document 1, the fresh toner conveyer and the recycled toner conveyer are each disposed horizontally and there is no mechanism for making the recycled toner flow more easily. Therefore, there is a problem that the recycled toner adheres to a screw of the toner conveyer or an inner wall of a pipe and accordingly a toner clogging is likely to occur in a toner conveying passage.

Additionally, the Patent Document 1 discloses a two-axis configuration in which the fresh toner conveyer and the recycled toner conveyer have a respective screw. The fresh toner conveyer and the recycled toner conveyer are each independently driven/controlled by a respective drive source. That would cause an increase in cost and size of the apparatus.

SUMMARY OF THE INVENTION

An image forming unit relating to one aspect of the present invention includes: an image carrier on which an electrostatic latent image is formed; a developer that develops the electrostatic latent image formed on the image carrier; a toner supplier that supplies the developer with toner to form a toner image on the image carrier; and a cleaner that, after the toner image formed on the image carrier is transferred onto a transfer member, collects toner remaining on a surface of the image carrier, the toner supplier comprising: a cylindrical conveying passage member; and a toner conveying rotational body that (i) includes a rotational shaft, and a first spiral blade and a second spiral blade that are wound in directions opposite to each other on different areas along the rotational shaft, (ii) is inserted in the cylindrical conveying passage member, and (iii) is rotated so that the first spiral blade and the second spiral blade convey toner in convergent directions, wherein the rotational shaft is inclined at a predetermined angle with respect to a horizontal plane such that the second spiral blade is higher than the first spiral blade, and the cylindrical conveying passage member comprises: a fresh toner receiving opening configured to receive fresh toner and disposed on a lower side of the inclined cylindrical conveying passage member where the first spiral blade is wound; a collected toner receiving opening configured to receive toner collected by the cleaner and disposed on an upper side of the inclined cylindrical conveying passage member where the second spiral blade is wound; and a toner supplier opening that is disposed at a position where the fresh toner conveyed by the first spiral blade and the collected toner conveyed by the second spiral blade meet, so as to supply the conveyed fresh toner and the conveyed collected toner to the developer.

An image forming apparatus relating to another aspect of the present invention is an image forming apparatus to which the above-mentioned image forming unit is demountably mounted.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes an embodiment of an image forming unit pertaining to the present invention with reference to the drawings, and the image forming unit is specifically applied to a copying machine as an example.

1-1. Overall Structure of Copying Machine

Figure 1:
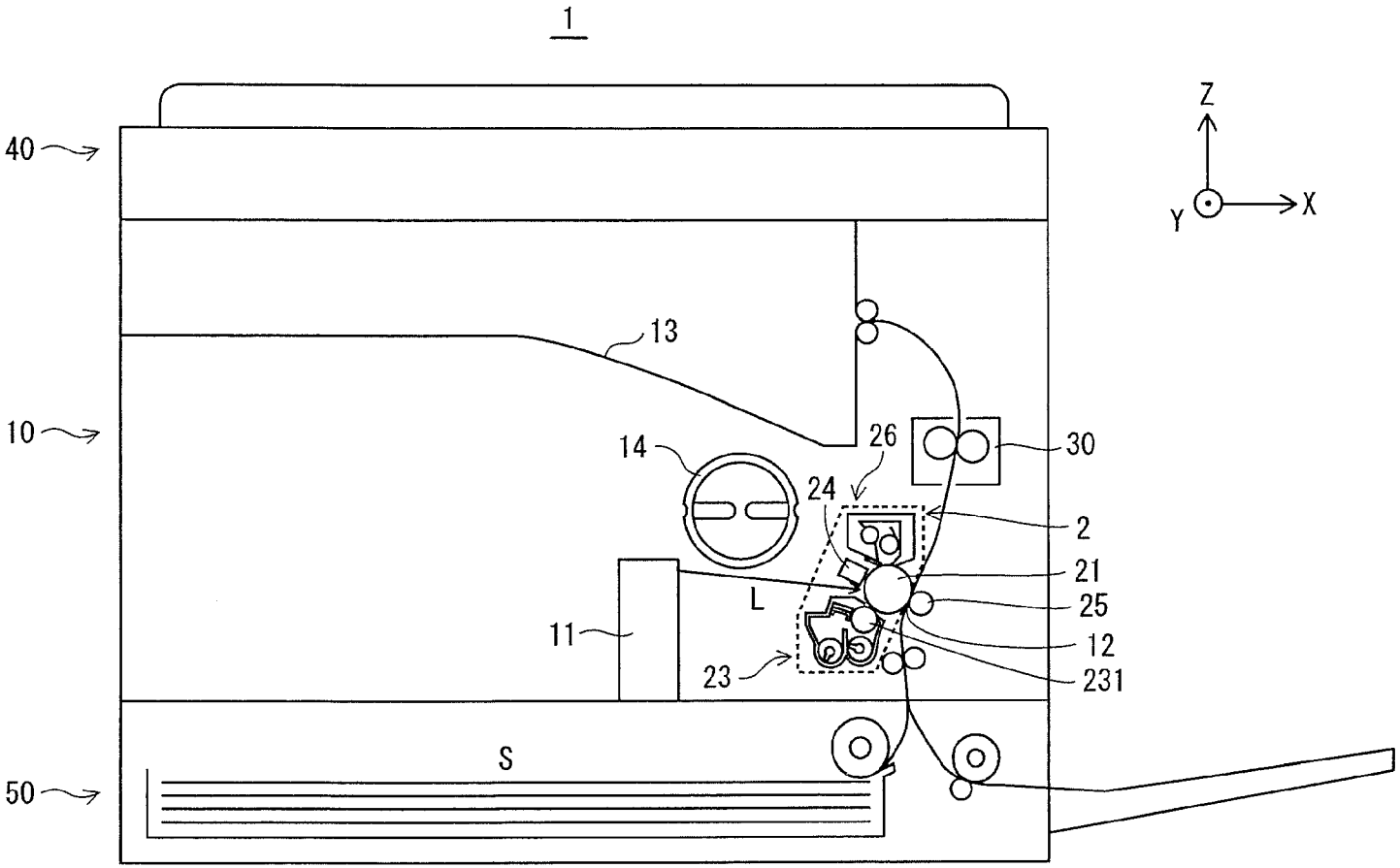
FIG. 1 is a schematic view showing an overall configuration of an image forming unit pertaining to an embodiment of the present invention.

FIG. 1 is a cross sectional view showing an overall structure of a copying machine 1 pertaining to the embodiment of the present invention.

The copying machine 1 includes an image forming part 10, a fixing part 30, a document reader 40, a feeder 50 and the like. The copying machine 1 forms an image based on image data of a document read by the document reader 40 by known electrophotographic methods.

The document reader 40 is a known image reading apparatus that forms image data of a document, by irradiating the document placed on a platen glass or the like with use of a light source and receiving the reflected light from a surface of the document with use of an image sensor such as a CCD.

The image forming part 10 includes an image forming unit 2 that forms a toner image, and an exposure-scanning part 11 that performs exposure scanning on a photoreceptor drum 21 that is an electrostatic latent image carrier included in the image forming unit 2.

The image forming unit 2 includes, in addition to the photoreceptor drum 21, other components such as a developing unit 23 that develops an electrostatic latent image formed on the photoreceptor drum 21, a charger 24 that is arranged around the photoreceptor drum 21, and a cleaner 26 that collects residual toner remaining on the photoreceptor drum 21 after transfer by removing the residual toner.

The exposure-scanning part 11 includes a light-emitting element such as a laser diode, and performs exposure scanning on the photoreceptor drum 21 by emitting laser light L for image forming, based on the image data read by the document reader 40. An electrostatic latent image is formed on the photoreceptor drum 21 as a result of the exposure scanning performed by the exposure-scanning part 11. Toner supplied by a developing roller 231 that is included in the developing unit 23 causes the formed electrostatic latent image to be visible, and accordingly a toner image is formed. At a transfer position 12, the toner image is transferred onto a sheet S that is conveyed from the feeder 50 in accordance with timing of transfer. The transferred toner image is then thermally fixed onto the sheet S by the fixing part 30. The sheet S is ejected to an external ejected-sheet tray 13 after the fixing.

Besides, in the present embodiment, a magnetic brush development method using a two-component developing agent is used. The developing roller 231 is composed of a developing sleeve into which a magnet roller is inserted, the magnet roller is fixed to a support shaft, and the developing sleeve is pivotally supported around the support shaft via bearings. Since these configurations have been known, an internal structure is not specifically illustrated and simply shown as the developing roller 231. Hereinafter, the same is applied to FIGS. 2-5.

1-2. Structure of Image Forming Unit

As FIG. 1 shows, the image forming unit 2 has the developing unit 23 that is positioned lower, the cleaner 26 that is positioned higher, and the photoreceptor drum 21 that is positioned therebetween. Additionally, the charger 24 is arranged between the developing unit 23 and the cleaner 26 so as to be adjacent to the photoreceptor drum 21.

Figure 2:
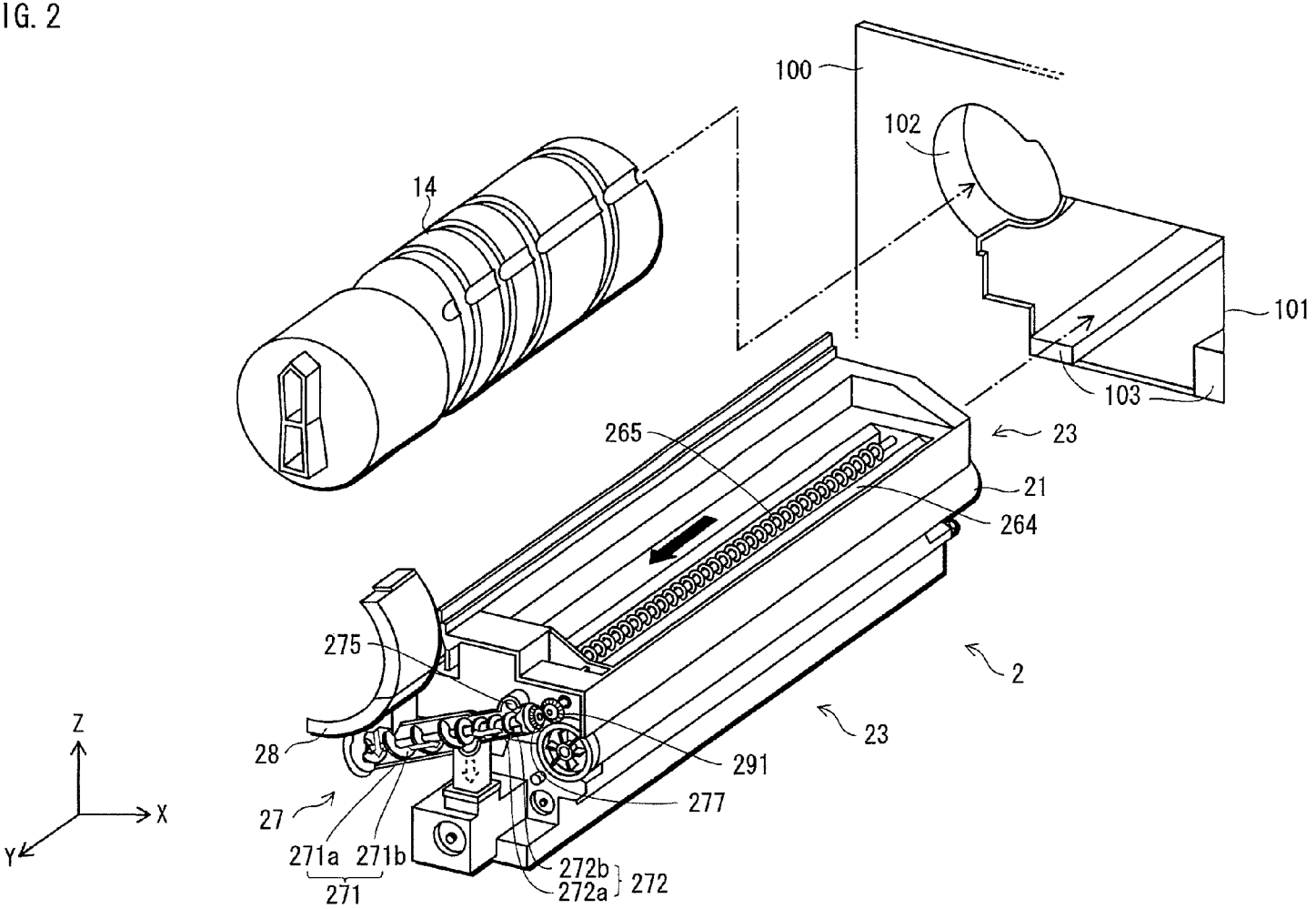
FIG. 2 is a perspective view showing a general configuration of the image forming unit pertaining to the embodiment of the present invention.

FIG. 2 is a partially cutout perspective view showing a general configuration of the image forming unit 2 and a toner bottle 14 that is a fresh toner container. Besides, FIG. 2 shows the image forming unit 2 without its upper surface such that it is easy to understand inside the cleaner 26.

As FIG. 2 shows, the image forming unit 2 includes a toner supplier (toner supplying part) 27 and a toner bottle receiver 28 at its front side (in a Y direction). These components are integrated to form the image forming unit 2.

The toner supplier 27 supplies the developing unit 23 with toner (fresh toner) discharged from the toner bottle 14 and residual toner (recycled toner) collected after transfer by the cleaner 26. The detail will be described later.

A frame 100 of the copying machine includes slots 101 and 102 for mounting and demounting the image forming unit 2 and the toner bottle 14, respectively. Inside the slot 101, a guide rail 103 is arranged such that a longitudinal direction of the guide rail 103 is arranged along a front-rear direction (in a Y axis direction) of the copying machine 1. The guide rail 103 slidably guides the image forming unit 2 in the front-rear direction of the machine.

An operator such as a user or a service person can mount the image forming unit 2 to the copying machine 1 by pushing the image forming unit 2 into the slot 101 toward a rear side of the copying machine 1 (in a −Y direction) along the guide rail 103 while supporting the image forming unit 2 substantially horizontally. Also, by pulling the image forming unit 2 toward the front side of the copying machine 1, the image forming unit 2 can be demounted.

The toner bottle 14 is demountable by performing the similar operation. When mounted to the copying machine 1, the toner bottle 14 is supported by the toner bottle receiver 28 and a toner bottle supporting member 19 (see FIGS. 3 and 4).

Figure 3:
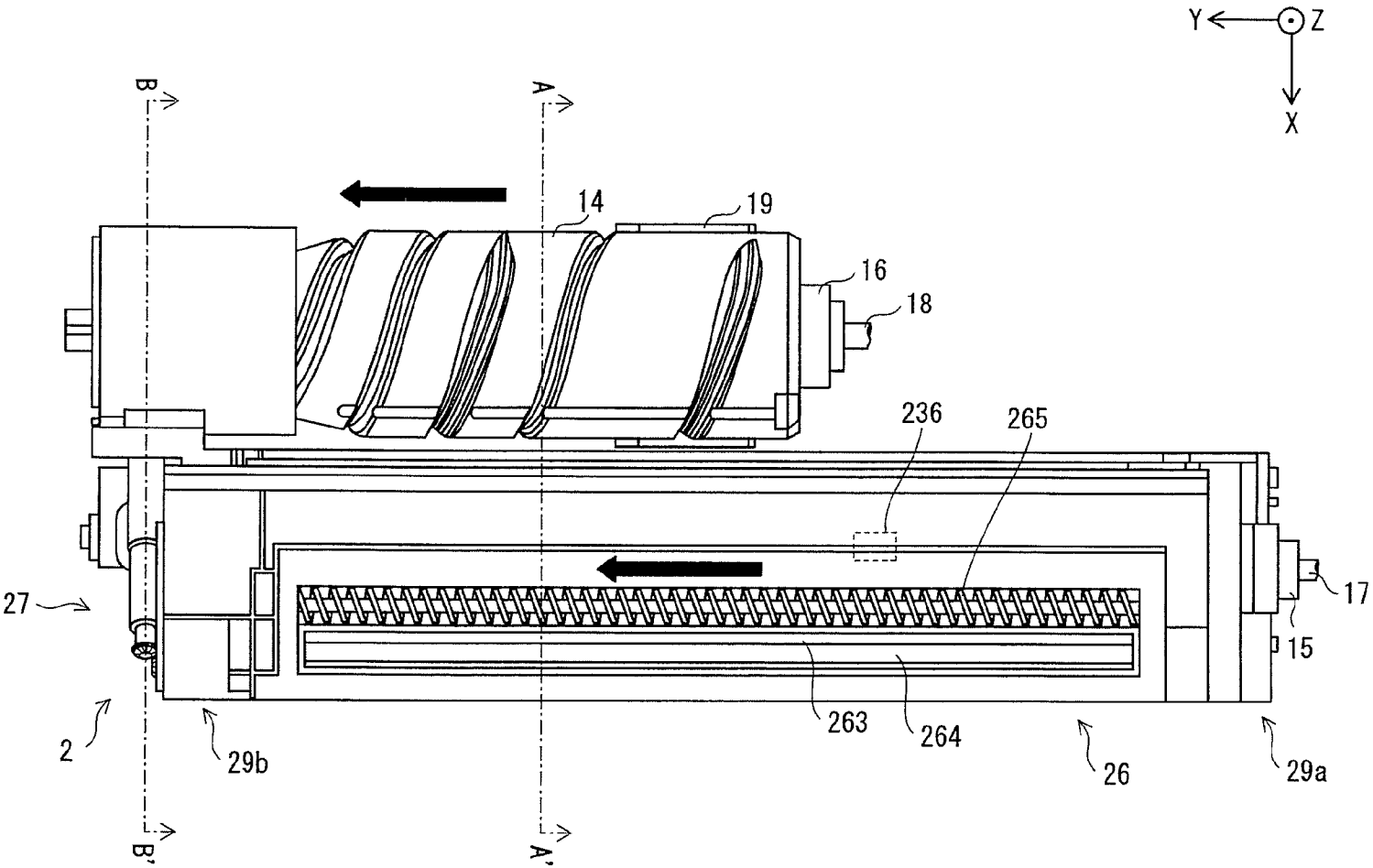
FIG. 3 is a plane view showing a general configuration of the image forming unit pertaining to the embodiment of the present invention.

FIG. 3 shows the image forming unit 2 and the toner bottle 14 viewed from above (in a −Z direction in FIG. 2), when each of them mounted to the inside of the copying machine 1. In this state, the image forming unit 2 is coupled to a driving axis 17 that is arranged at the rear inside (in the −Y direction) of the copying machine 1 via a coupler 15. Also, the toner bottle 14 is coupled to a driving axis 18 that is arranged at the rear side (in the −Y direction) of the toner bottle 14 inside of the copying machine 1 via a coupler 16. Rotational drive force of a motor inside the copying machine 1 is transmitted to the toner bottle 14 via the driving axis 18.

The toner bottle 14 has a cylindrical shape with a spiral protrusion at its inner surface. When the toner bottle 14 is rotated by the rotational drive force transmitted via the driving axis 18, toner is conveyed in the Y direction by the spiral protrusion, discharged from a toner discharging opening 141 (see FIG. 5) that is arranged adjacent to an end of the toner bottle 14 in a conveyance direction (in the Y direction), and supplied to the developing unit 23. The detail will be described later.

Also, rotational drive force of the driving axis 17 is transmitted, via gears (not illustrated) inside of a gearbox 29*a*, to the components such as the photoreceptor drum 21, a recycled toner collecting member 263, a recycled toner conveying screw 265, and a first stirring screw 232 and a second stirring screw 233. These components will be described later.

Figure 4:
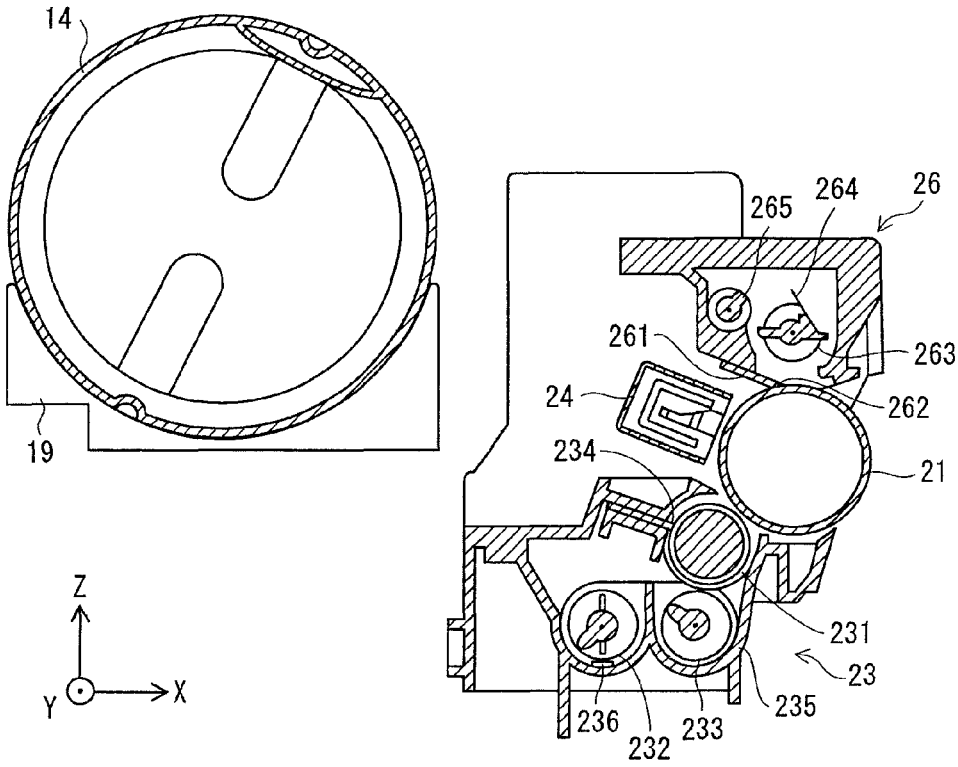
FIG. 4 is a cross sectional view of the image forming unit pertaining to the embodiment of the present invention, taken from line A-A' of FIG. 3.

FIG. 4 is a cross-sectional view of the image forming unit 2 and the toner bottle 14, taken from line A-A' of FIG. 3.

The developing unit 23 includes, in addition to the developing roller 231, other components such as the first stirring screw 232, the second stirring screw 233 and a doctor blade 234 that are held in a housing 235. Here, the first stirring screw 232 stirs and conveys the toner from the front side (in the Y direction) towards the rear side (in the −Y direction). The second stirring screw 233 conveys the toner that has been conveyed to the rear side to the forward side so as to supply the toner to an outer surface of the developing roller 231. The doctor blade 234 regulates a thickness of a layer of the toner adhered to the outer surface of the developing roller 231 to be constant.

In a toner conveying passage member, which is a part of the housing 235, where the first stirring screw 232 conveys the toner, a toner concentration sensor 236 is buried in a bottom wall. The toner concentration sensor 236 and the first stirring screw 232 do not contact with each other, and accordingly the toner concentration sensor 236 does not prevent rotation of the first stirring screw 232. The toner concentration sensor 236 is, for example, a magnetic sensor that detects magnetic permeability of a developing agent (toner and carrier) conveyed through the toner conveying passage member, based on a change in coil inductance. Based on the magnetic permeability detected by the toner concentration sensor 236, a ratio of a carrier that is a magnetic material in the developing agent is detected, and a ratio of the toner in the developing agent, that is, the toner concentration is indirectly detected. For example, when the ratio of the carrier included in the developing agent is small, the toner concentration is detected to be high. On the other hand, when the ratio of the carrier included in the developing agent is large, the toner concentration is detected to be low. After that, a detection signal from the toner concentration sensor 236 is input into a controller (not illustrated). Then necessary supply amount of toner is calculated based on the detection signal, and the toner bottle 14 is rotated by driving a motor (not illustrated) that is coupled to the driving axis 18. Accordingly a predetermined amount of fresh toner is supplied to the developing unit 23.

After the toner image formed on the photoreceptor drum 21 is transferred onto the sheet S (see FIG. 1), a cleaner blade 261 formed with elastic resin or the like scrapes the residual toner remaining on an outer circumferential surface of the photoreceptor drum 21 after transfer. The scraped toner accumulates in proximity to an end 262 of the cleaner blade 261. The accumulated toner is scooped up to the recycled toner conveying screw 265 by a paddle 264 mounted to the recycled toner collecting member 263 that rotates. The scooped toner is conveyed to the front side (in the Y direction) by the recycled toner conveying screw 265 and then conveyed to the toner supplier 27 (see FIGS. 2-3). The paddle 264 is, for example, made of a polyester film (PET film).

Figure 5:
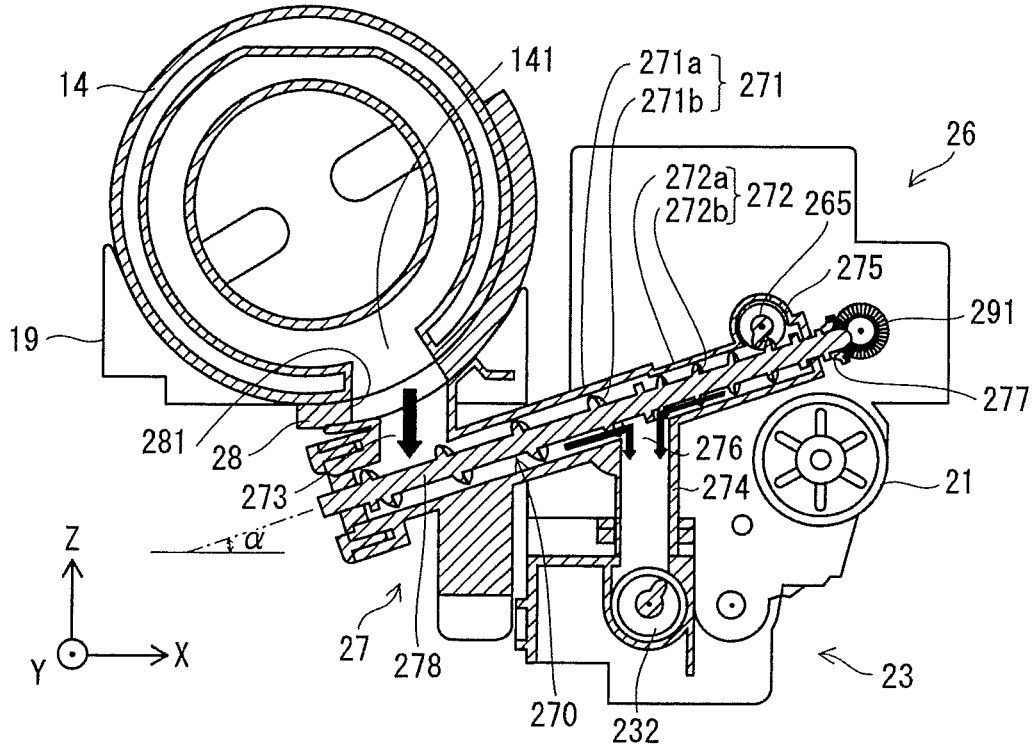
FIG. 5 is a cross sectional view of the image forming unit pertaining to the embodiment of the present invention, taken from line B-B' of FIG. 3.

FIG. 5 is a cross-sectional view of the image forming unit 2 and the toner bottle 14 that are each mounted inside of the copying machine 1, taken from line B-B' of FIG.3. As FIG. 5 shows, the toner supplier 27 is composed of components such as a first toner conveyer 271, a second toner conveyer 272, a fresh toner receiving opening 273, and a toner supplying passage 274. The first toner conveyer 271 is composed of a first cylindrical part 271*a* and a first toner conveying screw 271*b* that is rotatably disposed within the first cylindrical part 271*a*. The second toner conveyer 272 is composed of a second cylindrical part 272*a* and a second toner conveying screw 272*b* that is rotatably disposed within the second cylindrical part 272*a*. A diameter of the second cylindrical part 272*a* is smaller than a diameter of the first cylindrical part 271*a*. The first cylindrical part 271*a* and the second cylindrical part 272*a* integrally form the cylindrical toner conveying passage member, and have the one common axis. The second toner conveying screw 272*b* and the first toner conveying screw 271*b* are formed on a common single rotational axis 278 so as to integrally form a toner conveying rotating body 270. On the rotational axis 278, an area where the first toner conveying screw 271*b* is formed is substantially adjacent to an area where the second toner conveying screw 272*b* is formed. Also, the axis of the first cylindrical part 271*a* and the second cylindrical part 272*a* coincide with the rotational axis 278.

A blade of the first toner conveying screw 271*b* and a blade of the second toner conveying screw 272*b* are wound in directions opposite to each other. Therefore, the first toner conveyer 271 and the second toner conveyer 272 convey toner in directions opposite to each other. According to the present embodiment, the toner conveying rotating body 270 is rotated such that the first toner conveyer 271 and the second toner conveyer 272 convey the toner in convergent directions.

Also, as FIG. 5 shows, the first toner conveyer 271 and the second toner conveyer 272 are disposed in such a manner that their rotating axis 278 is inclined at a predetermined angle a with respect to a horizontal plane.

The fresh toner receiving opening 273 is disposed in proximity to an end of the first cylindrical part 271*a* that is opposite to the second cylindrical part 272*a*. Fresh toner discharged from the toner discharging opening 141 in accordance with a rotation of the toner bottle 14 is supplied into the first cylindrical part 271*a* via an opening 281 of the toner bottle receiver 28 and the fresh toner receiving opening 273.

Besides, in proximity to an end of the second cylindrical part 272*a* that is opposite to the first cylindrical part 271*a*, a recycled toner receiving opening 275 is arranged. The recycled toner conveyed by the recycled toner conveying screw 265 is supplied into the second cylindrical part 272 via the above recycled toner receiving opening 275 at an end of the conveying passage member. The recycled toner receiving opening 275 of the second toner conveyer 272 is positioned higher than the fresh toner receiving opening 273.

An end of the rotating axis 278 at a side of the second toner conveying screw 272*b* is sealed such that the toner does not leak, and rotatably supported with respect to the second cylindrical part 272*a*, and a bevel gear 277 is attached to its end that is protruded from the second cylindrical part 272*a*.

Besides, an end of the rotating axis 278 at a side of the first toner conveying screw 271*b* is also sealed such that the toner does not leak, and rotatably supported with respect to the first cylindrical part 271*a*.

The rotational drive force transmitted by the driving axis 17 via the coupler 15 (see FIG. 3) is transmitted directly to the photoreceptor drum 21, and is transmitted via a set of gears included in the gearbox 29*a*, to the recycled toner conveying screw 265, the recycled toner collecting member 263, the first stirring screw 232 and the second stirring screw 233. Also, the rotational drive force is transmitted to a bevel gear 291 via a set of gears (not illustrated) included in the gearbox 29*b*. The bevel gear 277 is meshed with the bevel gear 291 so as to rotate the toner conveying rotating body 270.

The fresh toner is discharged from the toner bottle 14, and supplied to the inside of the first cylindrical part 271*a* via the fresh toner receiving opening 273. The fresh toner is then conveyed up by the first toner conveying screw 271*b* from the bottom of the slope (from lower left to upper right in FIG. 5) inside the first cylindrical part 271*a*. The recycled toner collected by the cleaner 26 and supplied via the recycled toner receiving opening 275 is conveyed down by the second toner conveying screw 272*b* from the top of the slope (from upper right to lower left in FIG. 5) inside the second cylindrical part 272*a*. The fresh toner and the recycled toner meet at a meeting position in proximity to a joint of the first toner conveying screw 271*b* and the second toner conveying screw 272*b*.

At the meeting position, that is, at a base of a joint of the first cylindrical part 271*a* and the second cylindrical part 272*a*, a toner supplier opening 276 is disposed. The toner supplying passage 274 is connected to and positioned under (a −Z direction) the meeting position via the toner supplier opening 276. The fresh toner and the recycled toner that have been conveyed to the meeting position by the first toner conveying screw 271*b* and the second toner conveying screw 272*b* respectively are supplied to the developing unit 23 that is positioned below via the toner supplier opening 276.

As described above, since the rotating axis 278 is arranged inclined with respect to a horizontal plane, the fresh toner is conveyed up from the bottom of the slope, and the recycled toner is conveyed down from the top of the slope. Therefore, the recycled toner whose flowability is decreased is easy to flow from the top of the slope down with help of the gravity. This reduces an amount of the recycled toner adhered to an inner wall of the second cylindrical part 272*a*, especially, a clearance between the outer periphery of the second toner conveying screw 272*b* and the inner wall of the second cylindrical part 272*a*, or to the second toner conveying screw 272*b*, and accordingly occurrence of the recycled toner clogging can be suppressed.

Also, since the toner supplier 27 is inclined, the toner bottle can be positioned lower. It is therefore possible to reduce the height of the image forming unit including the toner bottle and contribute to downsizing of the image forming apparatus.

The angle $\alpha$ varies depending on the kind of toner employed, usage environment (such as temperature, humidity), material of the second cylindrical part 272 and the like. Specifically, the above goal can be achieved when the angle is 10-30 degrees, for example.

Here, a pitch (interval between adjacent blades of the screw) of the first toner conveying screw 271*b* is set to be larger than a pitch of the second toner conveying screw 272*b*. Specifically, for example, the pitch of the first toner conveying screw 271*b* is 15.8 (mm) and the pitch of the second toner conveying screw 272*b* is 9.0 (mm).

Also, a diameter of the first cylindrical part 271*a* is set to be larger than a diameter of the second cylindrical part 272*a*, and a diameter of the first toner conveying screw 271*b* is set to be larger than the second toner conveying screw 272*b*. Specifically, for example, a diameter of the first cylindrical part 271*a* is 14.7 (mm) and a diameter of the first toner conveying screw 271*b* is 13.4 (mm), and a diameter of the second cylindrical part 272*a* is 10.8 (mm) and a diameter of the second toner conveying screw 272*b* is 9.6 (mm).

This is because transfer efficiency of the image forming apparatus such as copying machines is normally approximately 80-90%, accordingly the residual toner that is collected after transfer as the recycled toner is normally only approximately 10-20%, and therefore conveyance of the recycled toner does not need so great conveying capacity. In addition, since the pitch and the diameter of the first toner conveying screw 271*b* is set to be larger, respectively, conveying capacity of the first toner conveyer 271 for conveying the fresh toner is greater. Therefore, when low toner concentration in the developing agent is detected by the toner concentration sensor 236, the fresh toner discharged from the toner bottle 14 can be speedily supplied to the developing unit 23.

Furthermore, the following effect may be expected. In a cross-sectional view, that is vertical to an axis of the second toner conveyer 272, there is a clearance part between the inner wall of the second cylindrical part 272*a* and the outer periphery of the second toner conveying screw 272*b*. In the clearance part, some of the recycled toner is in a space (dead space) between a lowest portion of the inner wall of the second cylindrical part 272*a* and a lowest portion of the outer periphery of the second toner conveying screw 272*b*. Such toner is positioned outside a rotational area of the second toner conveying screw 272*b* and accordingly does not contact with the blade of the second toner conveying screw 272*b*. Also, the toner does not fall inside the rotational area by its own weight and accordingly is likely to remain inside the second cylindrical part 272*a* without being conveyed.

Here, on the assumption that there are two cylindrical bodies each having recycled toner with the same amount therein. One having a smaller diameter has a higher level height of the recycled toner. This causes a ratio of the recycled toner existing in the rotational area of the screw to be greater. That is, this causes a ratio of the recycled toner existing in the dead space to be lower. Generally, as the diameter of the cylindrical part and the diameter of the screw are smaller, the clearance decreases, and accordingly the dead space decreases.

Therefore, by setting the diameter of the second toner conveyer 272 to be smaller than the diameter of the first toner conveyer 271, there is an effect of decreasing a ratio of the recycled toner existing in the dead space and reducing an amount of the recycled toner that is not conveyed and remains.

Besides, according to the present embodiment, the first toner conveyer 271 differs in both of the pitch and the diameter from the second toner conveyer 272. However, the first toner conveyer 271 may differ in either of the pitch or the diameter from the second toner conveyer 272. In such a case, by changing the pitch of the screw or the diameter, the fresh toner can be sufficiently speedily supplied.

Also, the first toner conveyer 271 and the second toner conveyer 272 may have the same pitch of the screw, the same diameter of the cylindrical part, and the same diameter of the screw. In such a case, the first toner conveyer 271 and the second toner conveyer 272 have the same conveying capacity, but occurrence of the recycled toner clogging can be suppressed due to the slope.

Furthermore, on the rotational axis 278, an area where the first toner conveying screw 271*b* is wound is substantially adjacent to an area where the second toner conveying screw 272*b* is wound. Alternatively, the following modifications can be made. That is, the area where the first toner conveying screw 271*b* is formed may be apart from the area where the second toner conveying screw 272*b* is formed. In this case, a toner supplier opening for supplying the conveyed toner to the developing unit 23 may be arranged in proximity to an end of each screw in each toner conveyance direction. Also, in the above case, the number of the toner supplier openings may be one that is sufficiently large. In such a case, the toner supplier opening receives both of the fresh toner and the recycled toner that are conveyed by the first toner conveying screw 271*b* and the second toner conveying screw 272*b*, respectively.

Besides, the first cylindrical part 271*a*, the second cylindrical part 272*a*, the fresh toner receiving opening 273 and the toner supplying passage 274 may be formed integrally.

Besides, specific values of the angle a of the inclination of the rotational axis 278 with respect to the horizontal plane, the diameters of the first cylindrical part 271*a*, the first toner conveying screw 271*b*, the second cylindrical part 272*a* and the second toner conveying screw 272*b*, and the pitches of the first toner conveying screw 271*b* and the second toner conveying screw 272*b* are examples, and as a matter of course, not limited to them.

The characteristics and effects of the present invention can be summarized as below.

One aspect of the present invention may be an image forming unit includes: an image carrier on which an electrostatic latent image is formed; a developer that develops the electrostatic latent image formed on the image carrier; a toner supplier that supplies the developer with toner to form a toner image on the image carrier; and a cleaner that, after the toner image formed on the image carrier is transferred onto a transfer member, collects toner remaining on a surface of the image carrier, the toner supplier comprising: a cylindrical conveying passage member; and a toner conveying rotational body that (i) includes a rotational shaft, and a first spiral blade and a second spiral blade that are wound in directions opposite to each other on different areas along the rotational shaft, (ii) is inserted in the cylindrical conveying passage member, and (iii) is rotated so that the first spiral blade and the second spiral blade convey toner in convergent directions, wherein the rotational shaft is inclined at a predetermined angle with respect to a horizontal plane such that the second spiral blade is higher than the first spiral blade, and the cylindrical conveying passage member comprises: a fresh toner receiving opening configured to receive fresh toner and disposed on a lower side of the inclined cylindrical conveying passage member where the first spiral blade is wound; a collected toner receiving opening configured to receive toner collected by the cleaner and disposed on an upper side of the inclined cylindrical conveying passage member where the second spiral blade is wound; and a toner supplier opening that is disposed at a position where the fresh toner conveyed by the first spiral blade and the collected toner conveyed by the second spiral blade meet, so as to supply the conveyed fresh toner and the conveyed collected toner to the developer.

According to the above structure, the recycled toner of which flowability is decreased is easy to flow from the top of the slope down with help of the gravity, and accordingly the recycled toner clogging can be suppressed. Additionally, since a single drive source can be used for driving both of the first conveyer and the second conveyer, it is possible to contribute to cost reduction and space saving by reducing the number of components.

Another aspect of the present invention provides the image forming unit, wherein the first spiral blade has toner conveying capacity greater than toner conveying capacity of the second spiral blade.

Yet, another aspect of the present invention provides the image forming unit, wherein the first spiral blade has a pitch larger than a pitch of the second spiral blade.

Yet, another aspect of the present invention provides the image forming unit, wherein the first spiral blade has a diameter larger than a diameter of the second spiral blade, and the cylindrical conveying passage member has a larger diameter in a part in which the first spiral blade is inserted than in a part in which the second spiral blade is inserted.

When toner concentration in the developer is low and the fresh toner needs to be supplied, the fresh toner can be speedily supplied to the developer in the above structures.

Also, the present invention may be an image forming apparatus that is equipped with either one of the above mentioned image forming units. In this case, the same effects as above can be expected.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming unit comprising: an image carrier on which an electrostatic latent image is formed; a developer that develops the electrostatic latent image formed on the image carrier; a toner supplier that supplies the developer with toner to form a toner image on the image carrier; and a cleaner that, after the toner image formed on the image carrier is transferred onto a transfer member, collects toner remaining on a surface of the image carrier, the toner supplier comprising:

a cylindrical conveying passage member; and a toner conveying rotational body that (i) includes a rotational shaft, and a first spiral blade and a second spiral blade that are wound in directions opposite to each other on different areas along the rotational shaft, (ii) is inserted in the cylindrical conveying passage member, and (iii) is rotated so that the first spiral blade and the second spiral blade convey toner in convergent directions, wherein the rotational shaft is inclined at a predetermined angle with respect to a horizontal plane such that the second spiral blade is higher than the first spiral blade, and the cylindrical conveying passage member comprises:

a fresh toner receiving opening configured to receive fresh toner and disposed at a first position along the inclined cylindrical conveying passage member where the first spiral blade is wound;

a collected toner receiving opening configured to receive toner collected by the cleaner and disposed at a second position along the inclined cylindrical conveying passage member where the second spiral blade is wound, wherein the first position is lower than the second position; and a toner supplier opening that is disposed at a position where the fresh toner conveyed by the first spiral blade and the collected toner conveyed by the second spiral blade meet, so as to supply the conveyed fresh toner and the conveyed collected toner to the developer.

2. The image forming unit of claim 1, wherein the first spiral blade has toner conveying capacity greater than toner conveying capacity of the second spiral blade.

3. The image forming unit of claim 2, wherein the first spiral blade has a pitch larger than a pitch of the second spiral blade.

4. The image forming unit of claim 2, wherein, the first spiral blade has a diameter larger than a diameter of the second spiral blade, and the cylindrical conveying passage member has a larger diameter in a part in which the first spiral blade is inserted than in a part in which the second spiral blade is inserted.

5. The image forming unit of claim 1, wherein, the predetermined angle of the inclination is between 10 degrees and 30 degrees inclusive.

6. An image forming apparatus to which the image forming unit of claim 1 is demountably mounted.

7. The image forming unit of claim 1, wherein the first spiral blade and the second spiral blade are each configured to rotate about a common rotational axis, the rotational axis being inclined at the predetermined angle with respect to the horizontal plane.

8. The image forming unit of claim 1, further comprising one motor configured to rotate both the first spiral blade and the second spiral blade.

* * * * *